United States Patent [19]

Redford

[11] 4,099,566

[45] Jul. 11, 1978

[54] VICOUS OIL RECOVERY METHOD

[75] Inventor: David A. Redford, Fort Saskatchewan, Canada

[73] Assignee: Texaco Exploration Canada Ltd., Calgary, Canada

[21] Appl. No.: 774,292

[22] Filed: Mar. 4, 1977

Related U.S. Application Data

[63] Continuation-in-part of Ser. No. 483,172, Jun. 26, 1974, Pat. No. 4,026,357.

[51] Int. Cl.[2] ..... E21B 43/24

[52] U.S. Cl. ..... 166/260; 166/261; 166/272

[58] Field of Search ..... 166/261, 260, 258, 259, 166/262, 251, 303, 272

[56] References Cited

U.S. PATENT DOCUMENTS

| | | | |
|---|---|---|---|
| 2,863,510 | 12/1958 | Tadema et al. | 166/260 |
| 3,131,761 | 5/1964 | Scott | 166/261 |
| 3,180,412 | 4/1965 | Bednarski et al. | 166/260 |
| 3,233,671 | 2/1966 | Chatenever | 166/260 |
| 3,294,167 | 12/1966 | Vogel | 166/258 X |
| 3,734,184 | 5/1973 | Scott | 166/261 X |
| 3,830,300 | 8/1974 | Allen | 166/261 |
| 3,964,546 | 6/1976 | Allen | 166/261 |
| 3,991,828 | 11/1976 | Allen et al. | 166/261 |

*Primary Examiner*—Stephen J. Novosad
*Attorney, Agent, or Firm*—Carl G. Ries; Thomas H. Whaley; Jack H. Park

[57] ABSTRACT

Solid hydrocarbon materials remaining in a subsurface earth formation such as, for example, the coke residue remaining in a subterranean tar sand deposit which has previously been exploited by means of a controlled oxidation process, is reignited and an oxygen-containing gas such as air is injected to burn the coke residue, thereby increasing the temperature of the sand or other formation matrix substantially. Water is then injected into the formation to absorb heat from the hot sand or formation matrix. Hot water and/or steam is thereby generated for use in thermal oil recovery methods in the immediate vicinity without the need for burning natural gas or other fuels which can be used more advantageously. Since the premeability of a tar sand formation is substantially greater at the conclusion of the controlled oxidaton reaction than it has initially, water containing appreciable solids suspended therein as well as minerals dissolved therein may be utilized without danger of plugging the formation, thus eliminating the cost of water treatment as would be required in conventional steam generation practice.

11 Claims, No Drawings

VICOUS OIL RECOVERY METHOD

CROSS-REFERENCE TO RELATED APPLICATIONS

This is a continuation-in-part of my copending application Ser. No. 483,172, filed Jun. 26, 1974 now U.S. Pat. No. 4,026,357.

BACKGROUND OF THE INVENTION

1. Field of the Invention

This invention concerns a process for utilizing solid hydrocarbon materials present in the subterranean formation and not otherwise recoverable therefrom for the purpose of heating water to generate steam and/or hot water for use in recovering viscous petroleum from subterranean, viscous petroleum-containing formations in the immediate vicinity.

2. Description of the Prior Art

Many subterranean, viscous hydrocarbon-containing deposits are not suitable for exploitation by conventional recovery techniques because the hydrocarbon materials are so viscous that they will not flow at formation temperature and pressure even if a substantial pressure differential is applied across a portion of the formation and the permeability of the formation is sufficient to permit fluid flow. For example, tar sand deposits such as those found in the western part of the United States as well as in the northern part of Alberta, Canada contain vast quantities of bituminous petroleum, but essentially no petroleum may be recovered by so called primary means because the viscosity of the bituminous petroleum at reservoir condition is in the range of millions of centipoise. Accordingly, some form of supplemental recovery process must be applied to these tar sand deposits, as well as to other subterranean, viscous petroleum-containing formations in order to recover any appreciable quantity of hydrocarbon or petroleum fluids therefrom.

A particularly promising supplemental recovery technique suitable for use in viscous oil formations and particularly in tar sand deposits is described in my application Ser. No. 481,581, filed June 21, 1974, now U.S. Pat. No. 4,006,778, which generally involves the use of air and steam in a critical ratio which produces a forward, controlled, low temperature oxidation reaction which propagates radidly through the tar sand deposits, mobilizing an appreciable quantity of viscous petroleum in the formation, and result in recovering as much as about 75 percent of the viscous petroleum present in the formation. This recovery technique is different from conventional in situ combustion processes and is more successful in application to tar sand deposits and similar viscous oil formations, because the permeability of the tar sand deposit is too low to permit application thereto of the conventional, forward high temperature in situ combustion as is practiced in more conventional oil recovery operations. Although this process results in an unusually high percentage recovery and is otherwise quite suitable for use in tar sand deposits, it does result in leaving a carbon, coke-like residue on the sand grain in the formation at the conclusion of the low temperature controlled oxidation reaction. This is in itself surprising, since although it is known that reverse in situ combustion results in the deposition of coke on the formation matrix, forward in situ combustion operations ordinarily do not result in the deposition of coke residue, rather leaving behind a farily clean sand.

In copending application Ser. No. 483,172, filed June 26, 1974, there is described a technique for converting the coke remaining on the tar sand grains at the conclusion of a low temperature controlled oxidation reaction, into a synthesis gas suitable for use as a fuel gas, as a substitute for natural gas or methane.

Most of the viscous oil recovery methods which have been previously considered for recovering extremely viscous oil such as that present in tar sand deposits, involve the injection of the thermal fluid into the formation to raise the temperature of the viscous petroleum, thereby reducing its viscosity to a level such that it will flow through permeable formation or a communication path present or formed in the formation, if sufficient pressure differential is applied to the heated viscous oil. Steam, hot water, or a mixture of steam and hot water are by far the most commonly utilized thermal fluids, because of their wide-spread availability and low cost.

The generation of steam and/or hot water for oil recovery operations is currently quite expensive because natural gas or other fuels suitable for use in generating the steam are in very short supply, and the costs thereof have escalated considerably. Accordingly, there is a substantial need for a method of generating steam and/or hot water for use in viscous oil recovery operations without the need to burn fuel which can be utilized more profitably and efficiently as a fuel for heating or other useful purposes.

Another major problem involved in generating steam is the treatment to which the feed water utilized for steam generation must be subjected before the water can be passed through a boiler or steam generator. Particulate matter suspended in water must be removed by filtration or other means in order to avoid clogging or otherwise interferring with the efficient operation of the boiler or steam generator. Minerals dissolved in the feed water must also be removed to avoid formation of scale on the boiler tubes which rapidly decreases the efficiency of the boiler, and chemical treatement techniques for removing scale-forming minerals from boiler feed water are expensive and not always entirely satisfactory. Accordingly, there is a substantial need for a means of generating steam for use in oil recovery operations using water containing excessive quantities of particulate matter dispersed therein and/or excessive quantities of minerals dissolved therein, without the expense of pretreating and conditioning the water prior to its use for steam generating.

It is an object of the present invention to satisfy at least some of these needs and at least certain preferred embodiments of the present invention as are described hereinafter below accomplish this object.

SUMMARY OF THE INVENTION

Solid hydrocarbon materials contained in a subsurface, porous, permeable formation, such as the coke residue deposited on sand grains in a tar sand deposit by a viscous oil recovery method in which a mixture of air and steam are injected into the formation to propagate a forward, low temperature, controlled oxidation reaction through the formation, may be utilized in a subsequent process as fuel for generation of hot water and/or steam in the subsurface formation for use in recovering viscous oil in an adjacent portion of the same or another formation in the immediate vicinity. The first step of the process of my invention involves injecting an oxygen-containing gas, preferably air or oxygen-enriched air into the formation to accomplish ignition of the coke residue remaining on the sand grains in the immediate vicinity of the air injection well. Once ignition is accomplished, air injection may be continued without applying any additional heat, since the combustion front is essentially self-sustaining. The forward high temperature combustion front generates temperatures as high as 1100° F, and results in raising the temperature of the formation sand grains contacted by the front to essentially the same temperature. Air injection is continued, preferably without injection of water, until the front has moved at least 50 percent of the distance between the injection well and a remotely located production well, and preferably until the combustion front reaches the production well. Water injection should then be initiated. The water injection rate is not critical, and it is determined by the rate at which steam generation is desired, rather than by formation limitation. The permeability of a tar sand deposit, although extremely low originally, is quite high after completion of the low temperature, controlled oxidation reaction, and formation receptivity is not a limitation to the water injection rate in the practice of this process. The final phase of the process will involve injecting water only to scavenge all available heat from the hot sand present in the formation, and the termination point is determined by the temperature of the fluid exiting from the remotely located production well.

DESCRIPTION OF THE PREFERRED EMBODIMENTS

Briefly, this invention concerns a method for burning the solid hydrocarbon materials contained in a subterranean, porous, permeable formation, such as the coke residue remaining on the sand grains of a tar sand deposit at the conclusion of a forward, low temperature controlled oxidation reaction, for the purpose of generating hot water and/or steam for use in nearby thermal oil recovery operations being applied to the same or other formations. Since the coke residue is unrecoverable by any known techniques, it must be converted to a recoverable form or utilized in the formation if any use is to be made thereof. Although a particularly preferred embodiment of the process of my invention involves application to a tar sand deposit which has previously been exploited by means of a low temperature, forward controlled oxidation reaction, it may be applied to other formations containing solid hydrocarbon materials, such as viscous oil formations which have been exploited by reverse or counter-current in situ combustion processes, or to naturally occurring solid or immobile hydrocarbon materials in the formations, provided the permeability of such naturally occurring solid hydrocarbon-containing formations is sufficient to permit injection thereinto of water, particularly the high solids content water such as may be utilized in the present application.

While the forward low temperature controlled oxidation reaction described above results in a very high total recovery efficiency when applied to subterranean tar sand deposits, it has been discovered that the formation contains about 3.2 percent of the hydrocarbon in the form of an essentially immobile, coke like residue deposited on the sand grains. Approximately half of this residue or 1.6 percent is soluble in hot toluene and the remaining 1.6 percent, which is predominantly carbon residue, is insoluble in hot toluene. The permeability of the depleted tar sand deposit is quite high, as contrasted to the original, very low permeability that exists in tar sand deposits in their native or undisturbed state, such as prior to application thereto of the low temperature controlled oxidation recovery process. The coke-like residue remaining in the formation is principally in the form of a thin film distributed fairly evenly throughout the formation, with most of the sand grain being more or less uniformly coated. Although the weight percent of hydrocarbon residue is only about 3.2 percent, it should be recognized that this still amounts to about 5 pounds of hydrocarbon per cubic foot of formation. In a 5,000 acre segment in which there is a tar sand deposit 100 feet thick, for example, this would mean that 105 billion pounds of solid hydrocarbon material remains in the formation at the completion of the first phase of the oil recovery process involving low temperature controlled oxidation. If the 105 billion pounds of hydrocarbon material can be utilized as a fuel for generating steam to be utilized in subsequent oil recovery applications in the same field, enormous quantities of natural gas or other fuel can be saved and utilized for heating or other useful purposes.

It is important in the practice of this process that air injection be initiated and ignition accomplished as in an ordinary forward in situ combustion operation, with no water injection being applied to the formation for a substantial period, preferably not until the combustion front reaches the production well. It is desired to burn the carbon residue completely before starting water injection, as injection of water simultaneously with air or other oxygen containing gas in the initial stage results in quenching of the combustion reaction or lowering its temperature, which interferes with complete combustion of the carbon residue. Furthermore, it is preferable for the combustion reaction to be completed in a segment of the formation and air injection terminated before water injection is initiated, in order to insure that neither flue gas nor air are co-mingled with the steam generated by application of the process. Thus, in a field in which the low temperature controlled oxidation reaction has been applied by means of two or more wells, at least one of which is an injection well and at least one of which is a production well, air injection is preferably continued until the thermal front reaches the production well, after which air injection should be terminated completely and injection of water for the purpose of generating steam from the heated formation should then be initiated. Water is injected into the formation for the purpose of scavenging heat from the hot sand grains or other mineral matrix. Since combustion of the carbon residue results in temperatures as high as 1100° F, the formation matrix is heated to a very high temperature and this heat is retained in the formation for long periods of time due to the subsurface location of the formation and the low thermal conductivity of surrounding earth formations.

Water is injected into the injection well at a rate determined by thermal fluid needs for any adjoining formation where it will be injected rather than any control parameter of the present process. Since the formation permeability will have been increased substantially by the prior oxidation process, water injection at very high rates is possible. The injection rate should be limited primarily by the requirements for hot water or steam in the related oil recovery operation.

As mentioned previously, the two principal advantages of utilizing the present method for generating steam and/or hot water for oil recovery operations are:

(1) Essentially unrecoverable hydrocarbon material is utilized as fuel. As a consequence of utilizing this material, a substantial amount of natural gas or other more versatile fuel is saved.

(2) Relatively dirty water, or water having appreciable quantities of solid, particulate matter dispersed therein, including fine silts and clays, as well as water containing appreciable amounts of salts and other minerals dissolved therein, can be utilized in this process without any appreciable water treatment. Since the permeability of the already exploited tar sand deposit is increased significantly at the conclusion of the forward, low temperature oxidation reaction over that existing prior to the oil recovery phase, deposition of particulate matter and/or mineral substances from water converted to steam will not adversely effect the permeability of the formation.

The air injection rate is preferably tapered in order to compensate for the changing geometry of the combustion front as the combustion front moves away from the injection well. Ordinarily, the air injection pressure is increased slowly to a final value well below the fracture pressure of the overburden, and the injection rate is determined by the injection pressure and formation air receptivity.

Ignition may be accomplished by any convenient means, including gas fired burners, electric burners or spontaneous ignition chemicals as are all amply described in the literature pertaining to the subject of in situ combustion. Ordinarily, it is only necessary to heat the formation immediately adjacent the injection well bore sufficiently to raise the temperature thereof to a value from about 700° to about 900° F, and maintain this temperature for a period of time from about 1 to about 5 days in order to initiate a stable, high temperature, forward in situ combustion reaction. In a preferred embodiment, from about 1 to about 20 gallons of a liquid fuel per foot of formation thickness are injected prior to ignition to increase the fuel density and thereby aid in igniting the coke residue. Crude oil or other liquid, combustible hydrocarbon materials are suitable for this purpose. Oils or fats are also excellent for this purpose, especially the unsaturated or drying oils such as linseed oil. Once the combustion front has been initiated, the burner or other supplemental heating technique may be removed from the well bore and air injection continued since the high temperature combustion reaction is self sustaining thereafter.

In a slightly different embodiment of the present invention, an oxygen-containing gas and a moderating fluid such as steam or carbon dioxide may be injected into the formation for the purpose of generating a synthetic fuel which is comprised principally of carbon monoxide and hydrogen, which fuel can be recovered from the formation and utilized on the surface for heating or other such purposes. The reaction which produces the synthetic fuel gas is also exothermic, and results in raising the temperature of the formation to about 500° to 700° F. While the temperature generated in the formation is not as high as is accomplished if an oxygen-containing gas such as air is injected without a moderating fluid, it is possible to generate appreciable amounts of steam or hot water for local thermal recovery use, in addition to the fuel value of the synthetic fuel gas which has been generated in the formation and recovered on the surface.

EXPERIMENTAL SECTION

In order to demonstrate the feasibility and operability of the present invention, and further for the purpose of illustrating the results obtained and to illustrate typical control parameters, the following experimental results are presented.

In all of the following tests, the experiments were conducted in a simulator cell which was approximately 18 inches in diameter and was packed with tar sand obtained from an open pit mining operation in the Athabasca Tar Sand Deposit. The material was packed to a specific gravity of 1.98, approximating the specific gravity of tar sand material present in tar sand formations. An overburden pressure of 500 pounds per square inch was applied for 7 days to compact the tar sand materials. A mixture of low quality (60 percent or less) steam and air were injected into the cell via an injection well completed in the cell for that purpose. The average ratio of air to steam was about 0.7 standard cubic feet of air per pound of steam, although it varied somewhat during the course of the run because of problems in maintaining injectivity. The low temperature controlled oxidation reaction succeeded in recovering about 75 percent of the bitumen present in the area normally swept by fluids injected between two wells completed in this particular cell. Examination of the contents of the cell after completion of this portion of the test revealed the solid coke like material rather evenly distributed throughout the depleted zone, coating essentially all of the sand grains in the cell.

The cell containing the coke like material remaining at the conclusion of runs identical to the preceding run was then subjected to various tests to determine if the residual coke could be ignited. Air was injected at a temperature of about 300° F for a period of time, but no ignition of the coke material was achieved. Improved heaters were utilized which permitted injecting air into the cell at a temperature of about 755° F, but ignition was still not accomplished. Three hundred milliliters of boiled linseed oil was then injected into the injection well and air was injected thereafter at a temperature of 805° F. This did succeed in igniting the residual coke in the formation, as was evidenced by the presence of carbon dioxide and carbon monoxide in the exhaust gases being produced from the cell, as well as by the occurrance of temperatures inside the bed which were higher than the temperature at the point of injection. Very little additional liquid hydrocarbons were obtained from the cell as a consequence of this reaction, indicating that while ignition had been achieved, the solid hydrocarbon material present in the cell could not be liquefied sufficiently to recover any significant portion thereof. Analysis of gases produced during the course of the run indicate about 80 percent oxygen utilization was accomplished, which indicates that an effective combustion process was achieved. Temperatures in the range of 1100° F were measured throughout the zone depleted by the original oil recovery process, and through which the high temperature reaction passed.

Another series of tests were performed which were essentially duplicates of the foregoing tests, and again it was demonstrated that the coke remaining in the conclusion of the forward, low temperature controlled oxidation reaction could be ignited, but only if linseed oil was injected and high temperature air were then injected for a period of approximately one hour. While temperatures upwards of 1100° F were again achieved in the zone originally depleted by the low temperature controlled oxidation reaction, essentially no additional bitumen or other hydrocarbons were recovered from the cell.

FIELD EXAMPLE

The process of my invention may be more fully understood by reference to the following field example, which is offered only for the purpose of additional disclosure and is not intended to be in any way limitative or restrictive of the process of my invention.

A tar sand deposit is located under an overburden thickness of approximately 600 feet, the thickness of the tar sand deposit being 125 feet. An injection well and production well are completed throughout the full thickness of the formation, the wells being approximately 200 feet apart. A boiler is connected to the injection well and 80 percent quality steam is injected into the formation via the injection well at a wellhead pressure of about 600 pounds per square inch. Air is blended with the steam and injected simultaneously therewith at an air-steam ratio of about 0.25 standard cubic feet of air per pound of steam. The air-steam accomplishes a forward, low temperature controlled oxidation reaction in the formation, which recovers approximately 75 percent of bituminous petroleum present in the formation within the area swept by the injected fluids. Cores taken from the swept area between the injection well and production well indicate that the sand grains are coated with a solid coke like material which is equivalent to about 3.8 percent by weight of the tar sand material. Since a similar field trial is planned approximately 1,000 feet distance from the present pilot, it is desired to burn the coke remaining in the swept area and utilize the heat generated thereby for the purpose of generating steam to be used in the accompanying pilot operation.

Approximately 400 gallons of linseed oil are injected into the injection well in order to increase the fuel density in the immediate vicinity of the injection well to a level at which ignition may be accomplished readily. A downhole gas-fired burner is positioned in the injection well at about the center of the formation, and air is injected while the gas fired burner is operated. Thermocouples indicate that the temperature of the air being injected into the formation is about 800° F, which together with linseed oil accomplishes ignition of the coke present in the formation. The burner is operated for 36 hours after which it is removed from the well and air injection is continued at a pressure of about 300 pounds per square inch. The air injection pressure is increased gradually, until the injection pressure if about 500 pounds per square inch after 20 days, and this injection pressure is maintained fairly constant thereafter. Air injection is continued until the temperature of the gases exiting from the production well reaches about 1000° F, indicating that the thermal front has reached the vicinity of the production well at which point air injection is terminated.

Water available in the area for the purpose of generating steam for the adjoining pilot contains approximately 2 percent by weight suspended silt and clay solids, and additionally has dissolved therein approximately 100,000 parts per million sodium chloride and 12,000 parts per million calcium and magnesium salts, expressed as calcium chloride. Such water would require extensive filtering and treatment to remove the suspended and dissolved materials if it were to be utilized in a conventional steam generator. Because the permeability of the already depleted tar sand deposited has been increased significantly and now is in the Darsy range, such treatment is not necessary as there is no danger of plugging such a high permeability formation. Water is injected into the formation at a relatively constant rate of about 1400 gallons per day, the water injection rate being determined primarily by steam requirements in the adjoining pilot. Water injection is continued until the temperature of the steam being produced from the producing well begins declining, and water injection is terminated completely when the fluid temperature reaches about 400° F, indicating that essentially all of the heat stored in the sand grains in the depleted zone of the formation has been scavenged and used for the purpose of generating steam.

Thus, I have disclosed that essentially solid hydrocarbon materials present in permeable subterranean formations such as the carbon residue remaining on sand grains in a tar sand deposit after completion of a forward, controlled, low temperature oxidation recovery operation can be burned and utilized for the purpose of generating steam for additional oil recovery purposes by injecting air into the formation and igniting the carbon residue, after which air injection is continued until the thermal front has reached at least a halfway point between the injection well and production well and preferably has reached the production well, after which water may be injected without conventional treatment into the injection well to generate steam and/or hot water for oil recovery purposes. While my invention has been described in terms of a number of specific illustrated embodiments, it is not so limited, as many variations thereof will be apparent to persons skilled in the related art. Similarly, while a mechanism has been proposed to explain the phenomena occurring upon application of the process of my invention, it is not necessarily represented hereby that this is the only mechanism or reaction occurring in the formation. It is my intention that my invention be limited and restricted only by those limitations and restrictions as appear in the claims appended immediately hereinafter below.

I claim:

1. A method of recovering hydrocarbons from a subterranean, porous, permeable, viscous petroleum-containing earth formation penetrated by at least one injection well and at least one production well in fluid communication therewith, comprising:

(a) introducing a mixture of air and steam into the formation via the injection well in a predetermined ratio to initiate and propagate a forward, low temperature controlled oxidation reaction through the formation, which forward low temperature controlled oxidation reaction results in displacing substantial amounts of viscous petroleum through the formation to the producing well and leaving a solid, coke like residue deposited on the formation mineral matrix;

(b) recovering petroleum from the formation via the production well;

(c) terminating injecting air and steam into the injection well when the low temperature controlled oxidation reaction reaches the production well;

(d) thereafter injecting from 1.0 to 20.0 gallons of liquid hydrocarbon fuel per foot of formation thickness at the injection well into the formation via the injection well;

(e) thereafter introducing a free oxygen-containing gas into the formation;

(f) heating the formation adjacent the injection well for a period of time sufficient to accomplish ignition of the liquid hydrocarbon fuel and coke-like residue on the formation mineral matrix;

(g) continuing injection of the free oxygen-containing gas to propagate a high temperature forward combustion reaction through the formation using the solid coke as fuel, for a period of time sufficient for the high temperature combustion reaction zone to reach the production well;

(h) thereafter discontinuing injecting the free oxygen-containing gas and injecting water containing suspended particulate matter and dissolved minerals into the injection well to contact the formation mineral matrix and scavenge heat therefrom, said water being converted to steam within the formation; and (i) recovering steam from the producing well to the surface of the earth.

2. A method as recited in claim 1 wherein the oxygen containing gas is air.

3. A method as recited in claim 1 wherein steam recovered from the producing well is reinjected into a remotely located injection well for the purpose of recovering viscous petroleum from a subterranean formation.

4. A method as recited in claim 1 wherein the combustible hydrocarbon liquid is an unsaturated oil.

5. A method as recited in claim 1 wherein the unsaturated oil is linseed oil.

6. A method as recited in claim 1 wherein the hydrocarbon liquid is petroleum.

7. A method of generating steam in a subterranean, porous, permeable earth formation, said formation also containing solid hydrocarbon fuel, said formation being penetrated by at least one injection well and by at least one production well, both wells being in fluid communication with the formation, comprising:

(a) injecting from 1 to 20 gallons of liquid hydrocarbon fuel per foot of formation thickness into the formation via the injection well;

(b) injecting a free oxygen-containing gas into the formation via the injection well;

(c) heating the formation adjacent the injection well for a period of time sufficient to ignite the injected liquid hydrocarbon and solid hydrocarbon fuel present in the formation immediately adjacent the injection well;

(d) continuing injection of an oxygen containing gas into the formation for a period of time sufficient to propagate a high temperature forward combustion reaction zone at least halfway between the injection well and production well;

(e) thereafter discontinuing injection of air;

(f) injecting water containing suspended particulate matter and dissolved minerals into the injection well, said water contacting heated formation matrix materials and as a consequence thereof, being converted into steam; and (g) recovering steam from the production well.

8. A method as recited in claim 7 wherein the liquid hydrocarbon is an unsaturated oil.

9. A method as recited in claim 8 wherein the unsaturated oil is linseed oil.

10. A method as recited in claim 7 wherein the liquid hydrocarbon fuel is petroleum.

11. A method as recited in claim 7 wherein the free oxygen containing gas is air.

* * * * *